United States Patent [19]

Richter

[11] 4,134,189

[45] Jan. 16, 1979

[54] TENTERING CLIP CHAIN

[75] Inventor: Hans H. Richter, Warwick, R.I.

[73] Assignee: Marshall & Williams Company, Providence, R.I.

[21] Appl. No.: 861,551

[22] Filed: Dec. 16, 1977

[51] Int. Cl.[2] ..... D06C 3/02

[52] U.S. Cl. ..... 26/89; 26/93; 26/96; 74/251 R

[58] Field of Search ..... 26/72, 73, 89, 93, 96; 74/251 R, 254, 256; 198/838, 851

[56] References Cited

U.S. PATENT DOCUMENTS

| | | | |
|---|---|---|---|
| 1,478,454 | 12/1923 | Renold | 26/96 |
| 3,555,637 | 1/1971 | Hyatt | 26/93 |
| 3,638,289 | 2/1972 | Dornier et al. | 26/93 |

FOREIGN PATENT DOCUMENTS

| | | | |
|---|---|---|---|
| 1337600 | 8/1963 | France | 26/73 |

*Primary Examiner*—Robert Mackey

[57] ABSTRACT

This invention relates to the base of tentering clips pivotally connected to form an endless tentering chain and specifically to a structure wherein three rollers are placed in tandem on opposite sides of the base and wherein the roller shaft is also the pivotal connection between adjacent clips.

5 Claims, 14 Drawing Figures

TENTERING CLIP CHAIN

STATEMENT OF INVENTION

The present invention relates to a new tentering clip base and more particularly to a tentering clip base structure wherein during travel through the tenter frame rail the frictional load on the clip is reduced; the roller shaft serving as the pivotal connection for adjacent clips.

PRIOR ART

With the advent of processing plastic sheet material in a tenter frame, came the problem of increased forces on the tentering clip. The magnitude of the increased forces was unknown to the textile industry where tentering clips originated. The present tentering clip was invented to cope with the greatly increased new forces, to prevent juxtapositioning between clips, to eliminate looseness in the endless chain and to increase rotational speed of the chain.

The tentering clip in accordance with the present invention is adapted for use in stretching a variety of sheet materials, among them being thermoplastic material such as polyester or polyethylene or fluorocarbons. Such material is conventionally extruded in sheet form substantially thicker than is finally desired, and is then stretched in either one or both directions to reduce the film to the desired thickness and to orient its molecules in order to increase its strength. Such plastic material, may, according to the use to which it is to be put, range in thickness in its extruded form from a few hundredths of an inch to one-quarter inch. It is desirable that the sheet material gripping means or tentering clips of the stretching or tentering apparatus, employed for processing the extruded plastic material, shall be strong enough to withstand the increased stretching forces needed to stretch plastic sheeting, as contrasted to cotton sheeting and that the clamping jaws of adjacent clips be aligned.

U.S. Pat. No. 3,555,637 dated Jan. 19, 1971 is directed to the requisite structure to stretch plastic sheeting due to the increase in operational forces.

Sheet material enters one end of a tenter frame and is removed at the opposite end thereof. In between, the two rails of the frame diverge to increase the width between the two rails and thereby stretch the material. Tentering clips at the material entering end of the tenter frame travel in two parallel straight lines and grip the material on opposite sides of a horizontal plane. As the rails diverge, the tenter clips leave the two parallel straight lines of travel to travel in two divergent widening curves. The area of material between adjacent clip jaws which is not actually gripped by the tentering clip jaws is distorted during travel through widening curves. This distortion is known as scalloping when the distance between tenter clip jaws increases, and is known as compressing when the distance between tentering clip jaws decreases. In the prior art, a loose pivotal connection existed between adjacent clips so that as between three pivotally connected clips, one would be mis-aligned or juxtapositioned in relation to the other clips.

OBJECTS OF THE INVENTION

Accordingly, it is a principal object of the present invention to provide a tentering clip with a structure which is strong enough to withstand the constricting forces inherent in plastic sheeting while providing the structure with means to reduce the frictional forces between the tentering clip and rail and to align the bite line of adjacent clips in one vertical plane.

Yet, another object of the invention is to provide a tentering clip structure with means to reduce the distance between adjacent tentering clips and thereby eliminate scalloping and compression.

It is another object of the present invention to provide three roller bearings in tandem with two of the roller bearings rotating in the same direction during the working cycle of the endless chain travel through the tenter rail and the other roller rotating in an opposite direction during the non-working cycle of travel.

Still another object of the present invention is to provide a tentering clip structure with a new linkage structure to reduce the "play" and freedom of movement between clips.

Other objects of the present invention will be pointed out in part and become apparent in part in the following specification and claims.

BRIEF DESCRIPTION OF THE DRAWINGS

Referring to the drawings in which similar characters of reference indicate corresponding parts.

THE SPECIFICATION

Figure 1:
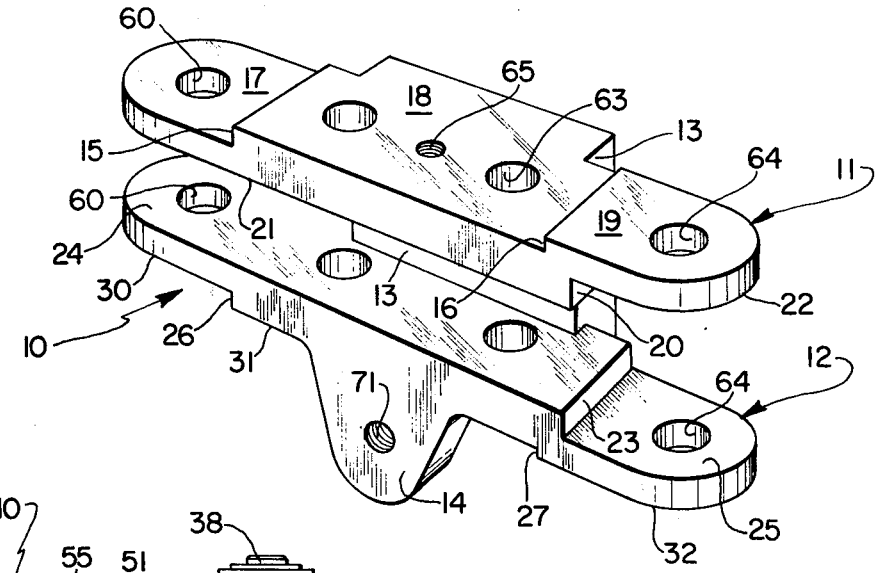
FIG. 1 is a perspective view of the new and improved tentering clip base.
Figure 2:
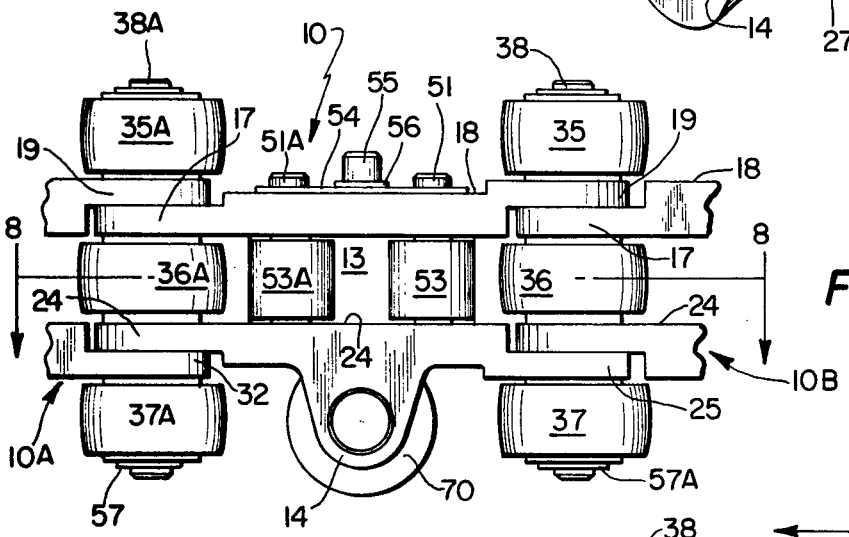
FIG. 2 is a rear elevational view of the new and improved tentering clip base.

Referring to the drawings and especially FIG. 1, the new and improved tentering clip comprises a base, generally indicated by reference numeral 10 comprising a horizontal upper plate 11, a horizontal lower plate 12 and a vertical wall 13 which is integrally connected to upper plate 11 and lower plate 12 and holds lower plate 12 in horizontal parallel spaced relationship with upper plate 11. Base 10, is generally, in the shape of the letter "C". A leg 14 depends from lower plate 12.

The top surface of upper plate 11 is provided with two ledges 15, 16 resulting in three platforms, lower 17, intermediate 18, upper 19. The underside of upper plate 11 is provided with a ledge 20 resulting in two platforms, bottom 21 and raised 22. In like manner, the upper surface of lower plate 12 is provided with one step 23 resulting in an upper shelf 24 and a lower shelf 25. The bottom surface of lower plate 12 is provided with two steps 26, 27 resulting in an upper shelf surface 30, an intermediate shelf surface 31 and a bottom surface 32.

A first aligned bore 60 is provided in lower platform 17 and upper shelf 24. A second aligned bore 61 is provided in intermediate platform 18 and upper shelf 24. A third aligned bore 63 is provided in intermediate platform 18 and upper shelf 24. A fourth aligned bore 64 is provided in upper platform 19 and lower shelf 25. A screw thread 65 is provided in intermediate platform 18 between second aligned bore 61 and third aligned bore 63.

Figure 6:
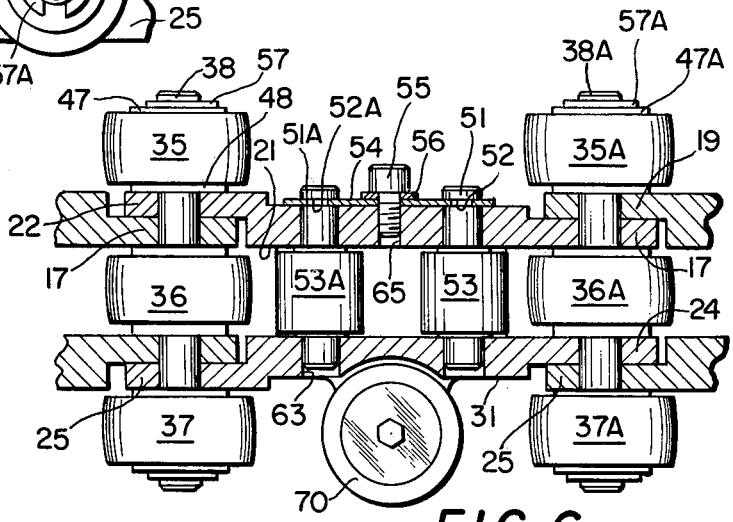
FIG. 6 is a vertical cross sectional view, taken on line 6—6 of FIG. 4.
Figure 8:
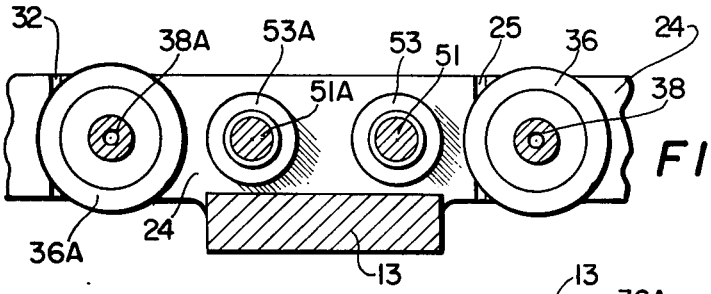
FIG. 8 is a bottom horizontal cross sectional view taken on line 8—8 of FIG. 2.
Figure 14:
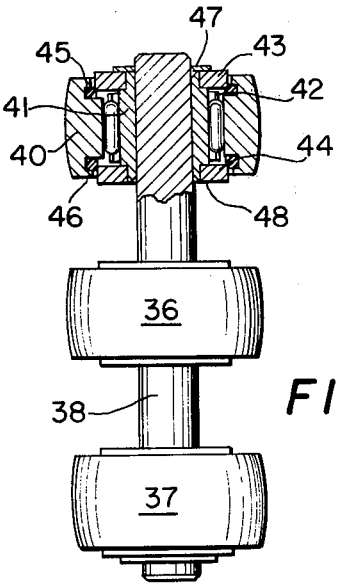
FIG. 14 is a partial vertical cross sectional view through one roller of the rollers in tandem and the supporting shaft.

Reference is made to FIGS. 6 and 14 wherein three anti-friction rollers 35, 36, 37 are rotatably mounted to a shaft 38. Each anti-friction roller consists of an outer race 40, an inner race 41, a retainer 42 and a left side keeper 43 and a right side keeper 44. A left side fluid seal 45 and a right side fluid seal 46 may also be provided. Keepers 43, 44 project beyond the left side and right side, respectively, of the outer race 40 to provide pads or seats 47, 48, respectively, for the anti-friction rollers. The inner race 41 is provided with a shaft bearing surface 50.

A first axle pin 51A provided with a recess 52 is positioned in second aligned bore 61. A second axle pin 51A provided with a recess 52A is positioned in third aligned bore 63. Two sleeve rollers 53, 53A are rotatably mounted, respectively, upon axle pins 51, 51A and are located between bottom platform 21 and upper shelf 24. A yoke 54 slidably engages recesses 52, 52A and lies upon intermediate platform 18. A cap screw 55 provided with a washer 56 is rotatably mounted in screw thread 65 fastening yoke 54 to intermediate platform 18 while yoke 54 secures axle pins 51, 51A in bores 61, 63, respectively.

Attention is directed to FIGS. 1, 2, 3, 4, 5 and 10 wherein a plurality of bases 10, 10A, 10B, etc., are pivotally connected as follows, into an endless chain. Two bases 10, 10A are assembled by placing the lower platform 17 of base 10 under raised platform 22 of base 10A with upper shelf 24 of base 10 overlying lower shelf 25 of base 10A. Shaft 38 is passed through fourth aligned bore 64 of base 10A and first aligned bore 60 of base 10 with anti-friction rollers 35, 36, 37 located, respectively, 35 adjacent upper platform 19, 36 between bottom platform 25 and upper shelf 24, and 37 adjacent bottom surface 32. Snap ring 57, 57A prevent anti-friction rollers 35, 37, respectively, from sliding off shaft 38. In this manner, three rollers 35, 36, 37 are held in tandem on one side of base 10 with the roller shaft 38 pivotally connecting adjacent base 10B to base 10. Similarly, base 10A is placed adjacent base 10 with raised platform 22 of base 10A overlying lower platform 17 of base 10 and with lower shelf 25 of base 10A underlying upper shelf 24 of base 10. Shaft 38A is passed through fourth aligned bore of base 10A and first aligned bore of base 10 with anti-friction rollers 35A, 36A, 37A located, respectively, 35A adjacent upper platform 19, 36A between bottom platform 21 and upper shelf 24, and 37A adjacent bottom surface 32. Snap rings 57, 57A prevent anti-friction rollers 35A, 37A, respectively, from sliding off shaft 38A. In this manner, three rollers 35, 36, 37 are held in tandem on one side of base 10 with the roller shaft 38A pivotally connecting adjacent base 10B to base 10. In this manner an endless chain is formed.

A weight support roll 70 is rotatably fastened to leg 14 by means of a stud fastened in screw threads 71 located in leg 14.

Figure 9:
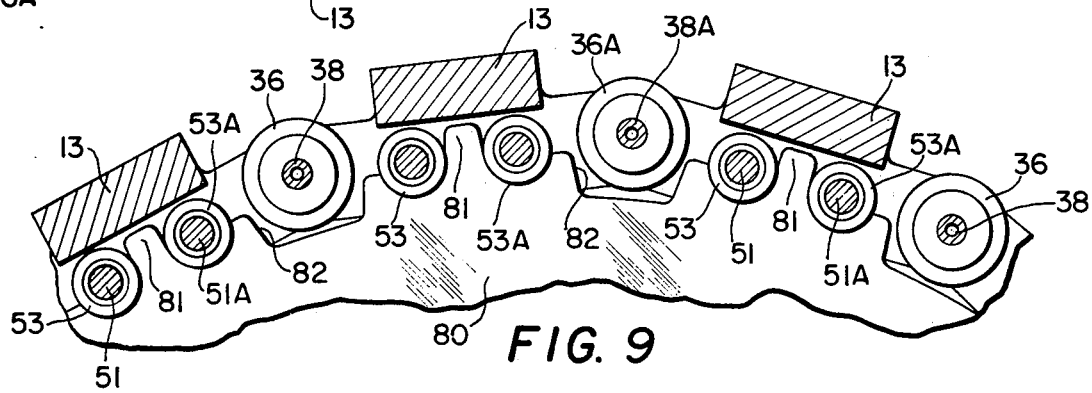
FIG. 9 is a fragmentary bottom plan view of a tenter frame chain and sprocket wheel.

FIG. 9 illustrates a segment of a sprocket 80 provided with teeth 81 and clearance areas 82 alternating with said teeth 81 to provide for the entwining of rollers 36, 36A, etc. Sleeve rollers 53, 53A embrace successive teeth 81 to drive the endless tentering clip chain.

Figure 11:
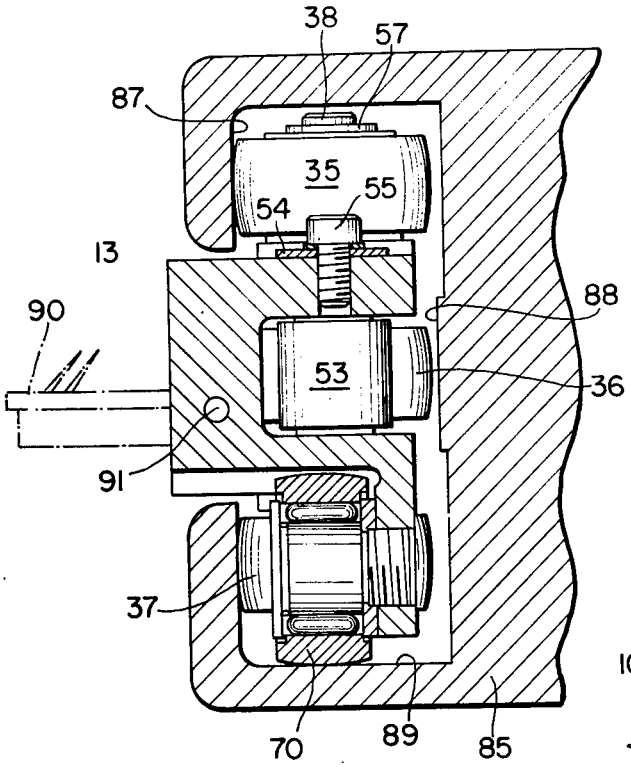
FIG. 11 is a vertical cross sectional view, taken on line 11—11 of FIG. 3 and shown in a fragmentary cross section of a tenter frame rail.
Figure 12:
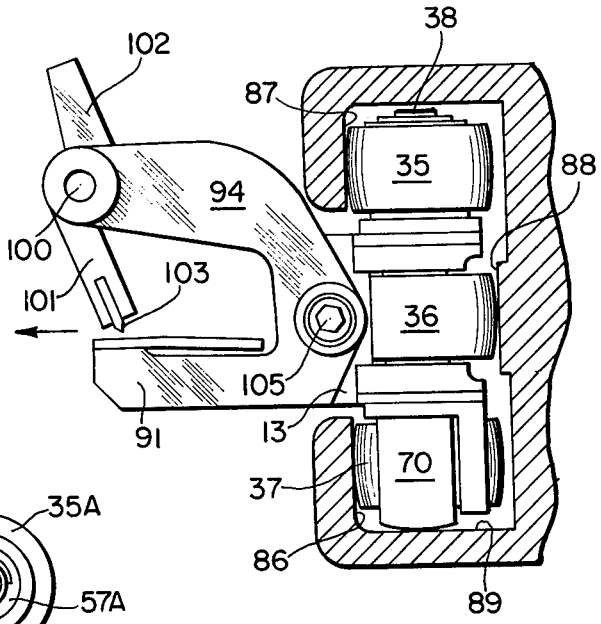
FIG. 12 is a side elevational view of the new and improved tentering clip base with the tentering clip jaw attached, and shown in location in a tenter frame rail.
Figure 13:
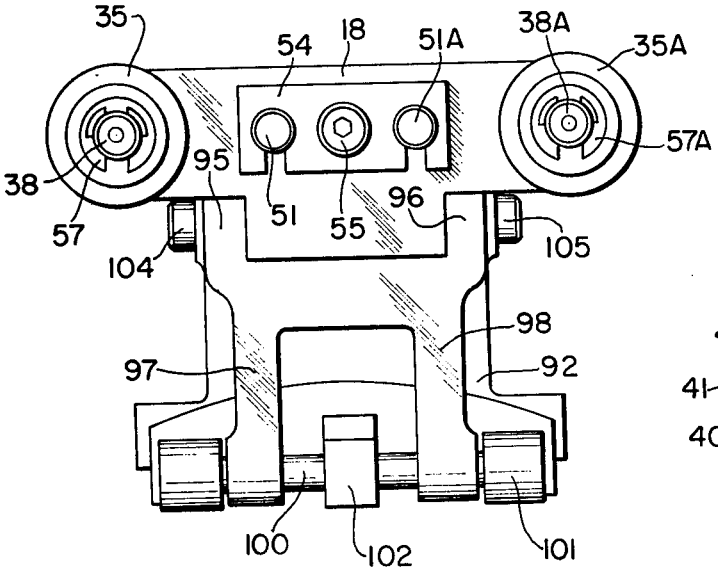
FIG. 13 is a plan view of FIG. 12 with the tenter frame rail removed.

Reference is made to FIGS. 11, 12 and 13 wherein is depicted, tentering clip tops fastened to tentering clip bases 10.

FIG. 11 illustrates, in cross section, a tentering machine rail 85 having a lower front rail face 86, an upper front rail face 87, a rear rail face 88, and a lower track 89. A pin plate 90 is fastened to wall 13 by means of a rod 91.

In FIGS. 12, 13, a tentering clip top comprises a horizontally disposed body 92, provided with a horizontal clamp surface 91, a vertical upstanding wall 94, in the form of a yoke having arms 95, 96 and a forward portion overlying said horizontal clamp surface 91 and terminating in a pair of spaced apart arms 97, 98. Pivotally mounted between spaced arms 97, 98 on a pintel 100 supported in arms 97, 98 is a jaw 101 provided with a projection 102 and a clamping edge 103. Jaw 101 is loosely hinged to pintel 100, so as to be normally free to move automatically into vertical relation with horizontally disposed clamp surface 91, under the action of gravity, to provide a material clamping action between edge 103 and clamping surface 91. Said yoke embraces the sides of wall 13 with a stud 104 fastening arm 95 to wall 13 and a second stud 105 fastening arm 96 to wall 13. In this manner, a two-piece clip is provided having a base 10 and interchangeable tentering clip tops. Obviously, tentering clip top and base can be integral or one piece.

In operation, roller 37 will ride against lower front rail face 86, and roller 35 will ride against upper front rail face 87 during the working cycle. Roller 36 will ride against rear rail face 88 during the return or non working cycle. Weight support roll 70 will ride against lower track 89 supporting base 10 and its tentering clip top.

Figure 3:
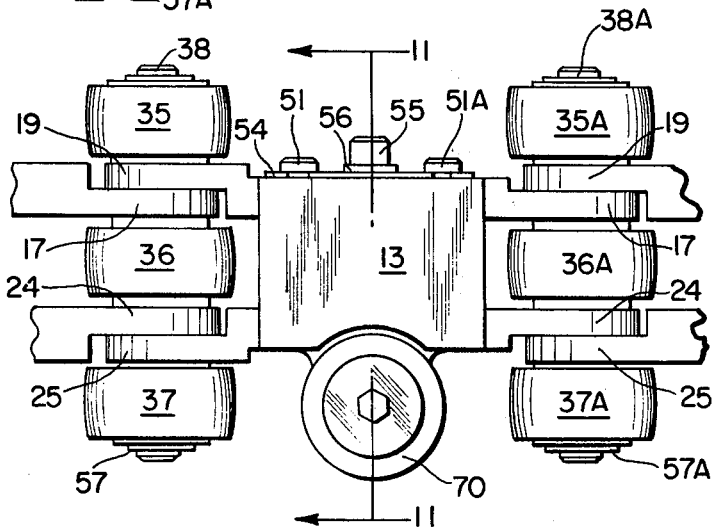
FIG. 3 is a front elevational view of the new and improved tentering clip base.
Figure 4:
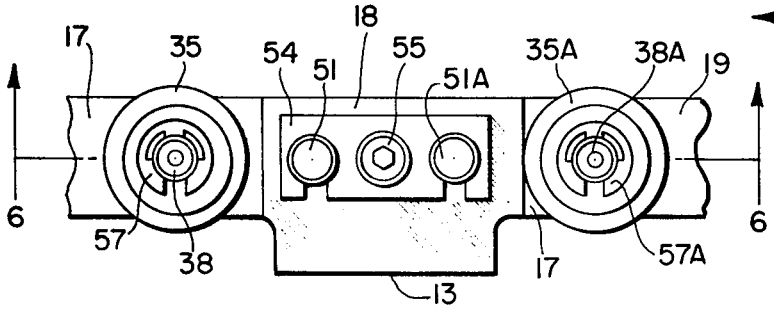
FIG. 4 is a top plan view of FIG. 3.
Figure 5:
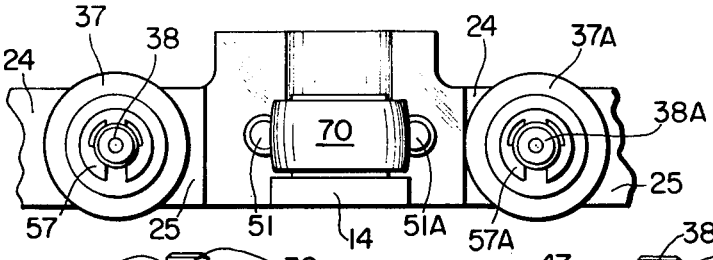
FIG. 5 is a bottom plan view of FIG. 3.
Figure 7:
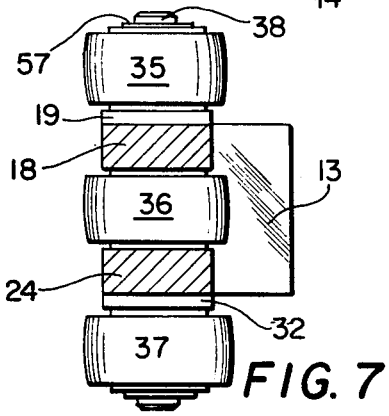
FIG. 7 is a right side elevational view of FIG. 10.
Figure 10:
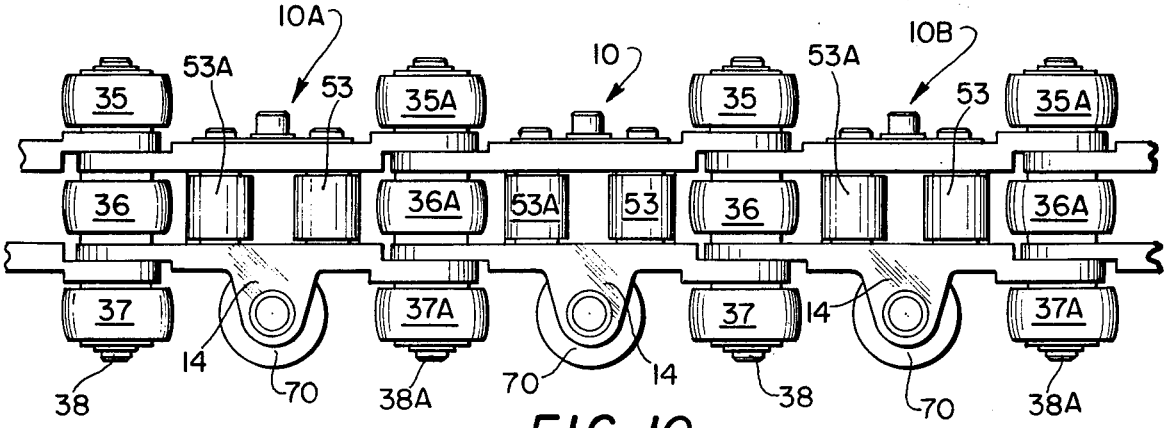
FIG. 10 is a rear elevational view, similar to FIG. 2 showing a plurality of tentering clip bases pivotally connected into an endless tentering clip chain.

With reference to FIGS. 3 and 12, it will be observed that the pull of the material in the direction of the arrow in FIG. 12, causes rollers 35, 37, 35A, 37A to balance the stress equally on all four rollers of each tentering clip because the stress is applied to wall 13 between sets of rollers. It will also be observed that each shaft 38 and set of three rollers 35, 36, 37 serve two bases. Therefore, an endless chain as shown in FIG. 10 has one pivot pin or shaft 38 less in number than the number of bases and/or tentering clips. This compactness of structure prevents juxtapositioning between bases 10 and permits the endless chain to rotate faster, thereby, increasing production.

The three tandem roller construction employing the roller shaft 38 as the pivotal connection between two bases etc., stabilizes movement of adjacent tentering clips and therefore stabilizes base movement throughout the entire endless chain; thus permitting the sleeve rollers 53, 53A to hug the teeth 81 of the sprocket 80, thereby, permitting a more efficient endless chain drive.

Having shown and described a preferred embodiment of the present invention by way of example, it should be realized that structural changes could be made and other examples given without departing from either the spirit or scope of this invention.

What I claim is:

1. A tentering clip chain comprising a plurality of tenter clip bases pivotally connected together, each base comprising an upper plate, a lower plate having a leg and a wall securing said upper plate in parallel spaced relation to said lower plate, a shaft provided with three rollers, means securing said shaft in said upper plate and said lower plate, a second shaft provided with three rollers, a second means securing said second shaft in said upper plate and said lower plate, means pivotally connecting the upper plate and lower plate of an adjacent base to said first mentioned shaft, and a second means pivotally connecting the upper plate and lower plate of an adjacent base to said second shaft on the side of said base opposite to said first mentioned adjacent base, a first axle pin provided with a sleeve roller, said axle pin being secured in said upper plate and said lower plate with said sleeve roller between said upper plate and said lower plate, and a second axle pin provided with a sleeve roller, said axle pin being secured in said upper plate and said lower plate with said last mentioned sleeve roller between said upper plate and said lower plate, a weight support roller, means rotatably mounting said weight support roller to said leg.

2. A tentering clip chain comprising a plurality of tenter clip bases pivotally connected together, each base comprising an upper plate, a lower plate and a wall integrally connected to said upper plate and to said lower plate to hold said upper plate and lower plate in parallel spaced relationship, a first aligned bore provided in said upper plate and said lower plate, a second aligned bore in said upper plate and said lower plate, a third aligned bore in said upper plate and said lower plate, a fourth aligned bore in said upper plate and said lower plate, a first axle pin secured in said second aligned bore, a sleeve roller rotatably mounted upon said first axle pin between said upper plate and said lower plate, a second axle pin secured in said third aligned bore, a second sleeve roller rotatably mounted upon said second axle pin between said upper plate and said lower plate, a shaft located in said first aligned bore, three rollers rotatably mounted upon said shaft, one roller abutting said upper plate, a second roller located between said upper plate and said lower plate, the last of said three rollers abutting said lower plate, means fastening said shaft to said upper plate and said lower plate, means pivotally connecting the upper plate and lower plate of an adjacent tentering clip base to said shaft, a second shaft located in said fourth aligned bore, three rollers rotatably mounted upon said shaft, one of said last mentioned rollers abutting said upper plate, a second of said last mentioned three rollers located between said upper plate and said lower plate, the third of said last mentioned three rollers abutting said lower plate, means fastening said second shaft to said upper plate and said lower plate, and means pivotally connecting the upper plate and lower plate of another adjacent tentering clip base to said second shaft.

3. The base as claimed in claim 2, said base having a leg, a weight support roller, means rotatably connecting said weight support roller to said leg.

4. A tentering clip chain comprising a plurality of tenter clip bases pivotally connected together, each base comprising an upper plate, a lower plate and a wall integrally connected to said upper plate and to said lower plate to hold said upper plate and said lower plate in parallel spaced relationship, said upper plate having two ledges in the top surface providing a lower platform, an intermediate platform, and an upper platform, the underside of said upper plate having a ledge providing a bottom platform and a raised platform, the upper surface of said lower plate having a step providing an upper shelf and a lower shelf, the bottom surface of said lower plate having two steps providing an upper shelf surface, an intermediate shelf surface and a bottom surface, a first aligned bore in said lower platform and upper shelf, a second aligned bore in said intermediate platform and upper shelf, a third aligned bore in said intermediate platform and upper shelf, a fourth aligned bore in said upper platform and lower shelf, a shaft, provided with three rollers, supported in said first aligned bore with one roller abutting said upper plate, a second roller located between said upper plate and said lower plate, the last of said three rollers abutting said lower plate, means securing said shaft in said first aligned bore, a second shaft provided with three rollers supported in said fourth aligned bore, one of said last mentioned rollers abutting said upper plate, a second of said last mentioned three rollers positioned between said upper plate and said lower plate, the third of said last mentioned three rollers abutting said lower plate, means securing said second shaft in said fourth aligned bore, a first axle pin provided with a sleeve roller supported in said second aligned bore with said sleeve roller between said intermediate platform and said upper shelf, a second axle pin provided with a sleeve roller supported in said third aligned bore, with said last mentioned sleeve roller between said intermediate platform and upper shelf, the first aligned bore of an adjacent base pivotally connected to said second shaft on one side of said base, the fourth aligned bore of an adjacent base pivotally connected to said shaft on the other side of said base.

5. The base as claimed in claim 4, said base having a leg, a weight support roller, means rotatably connecting said weight support roller to said leg.

* * * * *

UNITED STATES PATENT AND TRADEMARK OFFICE

CERTIFICATE OF CORRECTION

PATENT NO. : 4,134,189

DATED : January 16, 1979

INVENTOR(S) : Hans Heinrich Richter

It is certified that error appears in the above-identified patent and that said Letters Patent are hereby corrected as shown below:

On the Title Page Assignee should read

-- Marshall and Williams Company --.

Same Title Page, before "Abstract" insert

-- Attorney, Agent, or Firm - William Frederick Werner --.

Signed and Sealed this

*Tenth* Day of *July 1979*

[SEAL]

*Attest:*

*Attesting Officer*

LUTRELLE F. PARKER

*Acting Commissioner of Patents and Trademarks*